US006223529B1

(12) United States Patent
Achten

(10) Patent No.: US 6,223,529 B1
(45) Date of Patent: May 1, 2001

(54) HYDRAULIC SYSTEM WITH A HYDROMOTOR FED BY A HYDRAULIC TRANSFORMER

(75) Inventor: Peter Augustinus Johannes Achten, Eindhoven (NL)

(73) Assignee: Innas Free Piston B.V., Breda (NL)

( * ) Notice: Subject to any disclaimer, the term of this patent is extended or adjusted under 35 U.S.C. 154(b) by 0 days.

(21) Appl. No.: 09/424,354

(22) PCT Filed: May 27, 1998

(86) PCT No.: PCT/NL98/00306

§ 371 Date: Feb. 29, 2000

§ 102(e) Date: Feb. 29, 2000

(87) PCT Pub. No.: WO98/54468

PCT Pub. Date: Dec. 3, 1998

(30) Foreign Application Priority Data

May 28, 1997 (NL) ..... 1006144

(51) Int. Cl.[7] ..... F04B 49/00
(52) U.S. Cl. ..... 60/416; 60/419
(58) Field of Search ..... 60/413, 414, 416, 60/419

(56) References Cited

U.S. PATENT DOCUMENTS

| | | | | |
|---|---|---|---|---|
| 3,294,369 | * | 12/1966 | Butler | 60/419 X |
| 3,627,451 | | 12/1971 | Kouns . | |
| 3,838,574 | * | 10/1974 | Gelders | 60/494 |
| 4,077,746 | | 3/1978 | Renynolds | 60/419 X |
| 4,255,957 | * | 3/1981 | Davydov et al. | 72/279 |
| 4,974,994 | * | 12/1990 | Kirstein et al. | 60/414 X |
| 5,628,188 | | 5/1997 | Kordak . | |
| 5,852,933 | * | 12/1998 | Schmidt | 60/413 |
| 6,116,138 | * | 9/2000 | Achten | 60/419 X |

FOREIGN PATENT DOCUMENTS

| | | |
|---|---|---|
| 3404534 | 9/1985 | (DE) . |
| 4420704 | 12/1995 | (DE) . |
| WO 9731185 | 8/1997 | (WO) . |

* cited by examiner

*Primary Examiner*—John Ryznic
(74) *Attorney, Agent, or Firm*—Kinney & Lange, P.A.

(57) ABSTRACT

A hydraulic system includes a hydraulic transformer with a rotor which is coupled with the hydromotor. The hydromotor may be subjected to a variable load which has to be moved in different directions. By using various switching means, the combination hydromotor and hydraulic transformer has been made suitable for the necessary four-quadrant operation.

14 Claims, 1 Drawing Sheet

HYDRAULIC SYSTEM WITH A HYDROMOTOR FED BY A HYDRAULIC TRANSFORMER

Figure 1:
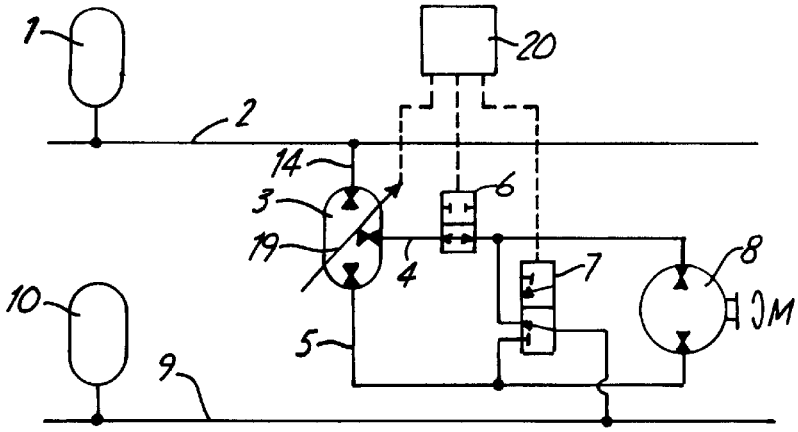

The invention relates to a hydraulic system in accordance with the preamble of claim 1.

Such a hydraulic system is described in the not pre-published WO application 9731185 by the same applicant. This application describes a hydraulic transformer in which an oil flow of a first pressure is transformed to an oil flow of a second pressure by means of supplying or discharging a third oil flow of low pressure. Such a hydraulic transformer has proved to be particularly suitable for use with hydromotors which are used in so-called four-quadrant operation. This means that the hydromotors are used in two directions of movement and in two directions of loading so that they accelerate as well as delay in both directions. The added possibility of recovering energy during braking makes the use of such hydraulic transformers very attractive, especially in combination with the fast adjustment facilities of the hydraulic transformer described in WO 9731185.

When the hydromotor is coupled directly to the hydraulic transformer and the load on the motor is reversed and consequently the pressures in the hydraulic transformer are reversed, the application of the known hydraulic transformer in a hydraulic system designed for the above-mentioned four-quadrant operation causes undesirable conditions such as, for instance, cavitation. This occurs if after reversal of the load the motor and consequently also the rotor in the hydraulic transformer keep moving in the same direction due to, for instance, the inertia of the moving mass.

It is the object of the invention to improve these matters and to this end switching means are present for connecting the low-pressure pipe with the first user's port or with the second user's port.

Alternately connecting the low-pressure pipe with either the first user's port or the second user's port prevents the development of negative pressures in the hydraulic transformer, thereby avoiding cavitation.

In accordance with an improvement of the invention the operation of the switching means is coupled with the operation of the adjustment device. The fact that the load of the hydromotor is produced by the alteration of the pressure ratio between the high-pressure connection, the first user's port and the second user's port, and thus as a result of the adjustment of the adjustment device, and the fact that simultaneously also another flow through the hydraulic transformer has to take place, allows the switching means and the adjustment device to be coupled, whereas facilitating operation.

In accordance with one embodiment the switching means comprise valves which form part of the adjustment device. The incorporation of the valves in the adjustment device makes operating simple. This embodiment may be employed, for instance, if the adjustment device can be operated manually.

In accordance with another embodiment the switching means comprise valves that are operated by means of a lever, which lever is coupled with the adjustment device. By coupling the valves with the adjustment device by means of a lever a simple manner of operation is obtained. This embodiment may be employed, for instance, if the adjustment device can be operated manually.

In accordance with another embodiment the switching means comprise hydraulically operated valves which are activated by the pressure of the first user's port and the second user's port. This means that the construction may be simple because simply operated valves can be used such as, for instance, pressure-controlled non-return valves.

In accordance with another embodiment the switching means comprise electrically operated valves. Using electrically operated valves involves that they can be placed at various locations in the device to be driven.

The invention also relates to the known hydraulic system described earlier, where a stop valve is provided in one of the connecting pipes, between the hydraulic transformer and the hydromotor. Such a stop valve is necessary in order to prevent the hydromotor from moving under the influence of a load. When the setting of the adjustment device is such that the oil supply from the high-pressure pipe is zero, and the two connections of the hydromotor have the same pressure, the absence of a stop valve might mean that an external load could cause the rotor in the hydraulic transformer to rotate, which may be undesirable.

In accordance with a further improvement of the invention in which the low-pressure pipe is optionally permanently connected with the first user's port or the second user's port a short-circuiting pipe is provided between the first user's port and the second user's port, optionally provided with a valve. This means that while the hydromotor is at a standstill, the hydraulic transformer's rotor can continue to rotate above a minimum number of revolutions, which is an improvement, since due to the limited number of chambers, the rotation of the hydraulic transformer's rotor can become unstable below a certain minimum number of revolutions.

According to an embodiment of the hydraulic system in accordance with the invention, said embodiment is executed having a hydromotor which is loaded in one direction, with a connecting pipe which is connected with the first user's port provided with a shuttle valve between the high-pressure pipe and the hydraulic transformer and the connecting pipe, and between the hydraulic transformer and the hydromotor. This allows the reversal of the drive's direction of movement, so that the energy released during the movement of the load is returned into the high-pressure pipe, while the rotational direction of the rotor in the hydraulic transformer does not change. As a result the rotor does not need to come to a stop but can continue to rotate at least at the minimum number of revolutions.

In accordance with a further improvement the shuttle valve has a rest position for closing off the connecting pipe while the high-pressure pipe is opened. This simple manner allows the hydromotor to be maintained in a certain position.

Figure 2:
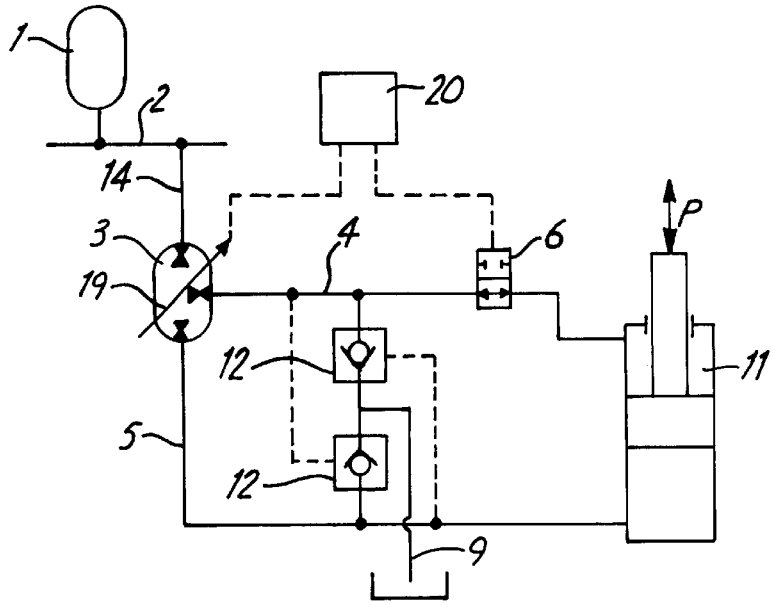
Figure 3:
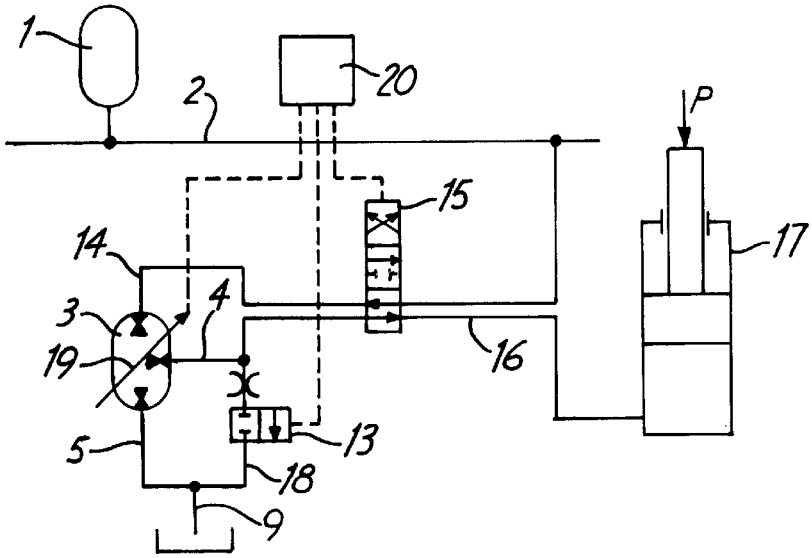

The invention will now be elucidated on the basis of a few exemplary embodiments and with reference to a drawing, in which FIG. 1 shows a schematic diagram of a first embodiment of a hydraulic system in accordance with the invention, FIG. 2 shows a schematic diagram of a second embodiment of a hydraulic system in accordance with the invention, and FIG. 3 shows a schematic diagram of a third embodiment of a hydraulic system in accordance with the invention.

The various parts in the diagrams are represented schematically, while constructions commonly known and used in hydraulic systems, such as among others for the safe-guarding of motors and the like, are not shown. Where possible, corresponding parts in the various Figures have been provided with identical reference numbers.

FIG. 1 shows a hydraulic system in which a high-pressure pipe 2 is connected with a pressure accumulator 1. The high-pressure pipe 2 is connected with a hydraulic transformer 3 via a pressure connection 14. Said hydraulic transformer 3 is equipped with an adjustment device 19 and is also provided with a first user's port 4 and a second user's port 5. The hydraulic transformer 3 is provided with a housing and with a rotor which is rotatable in the housing, chambers distributed around the rotation shaft, driving means which, when the rotor rotates in the housing displace impellers, causing the volume of the chambers to vary between a minimum and a maximum value, channels provided with valves which are activated by the rotation of the rotor and which alternately connect the chambers with the high-pressure connection 14, the first user's port 4 and the second user's port 5, and wherein the adjustment device 19 can adjust the circuiting positions of the valves with respect to the rotational position of the driving means. The hydraulic transformer 3 is described in more detail in WO 9731185 by the same applicant, which document is herewith considered to form part of the present application.

The first user's port 4 and the second user's port 5 are connected with the connecting ports of a rotating hydromotor 8 which can be loaded with a torque M, which is variable both in size and direction. One of the pipes to the hydromotor 8 incorporates a stop valve 6 for stopping the hydromotor 8. Via a 3/2-valve 7 the first user's port 4 and the second user's port 5 are connected with a low-pressure pipe 9 which is provided with a pressure accumulator 10. Via a control 20 the operation of the adjustment device 19 is coupled with the 3/2-valve 7. Said coupling may also be effectuated in other ways, for instance, by combining the valves with the adjustment device, by coupling, for instance, with levers, by hydraulic or electrical couplings, wherein the different manners of coupling are determined by the application of and manner in which the adjustment device 19 is activated and the application of the hydromotor 8. The adjustment device 19 and the 3/2-valve 7 can also be operated independently of one another. The stop valve 6 will usually be operated independently of the adjustment device 19 and the 3/2-valve 7, for instance by the control 20.

The hydromotor 8 can be operated by adjusting the adjustment device 19, with the position of the adjustment device 19 determining, among other things, the pressure ratios between the high-pressure connection 14, the first user's port 4 and the second user's port 5, and consequently the size and the direction of the torque M. For operating the adjustment device, the control 20 is coupled with the sensors (not shown). The control is based on, for instance, an adjusted speed or number of revolutions of the hydromotor 8, while other adjustments are also possible such as, for instance, a desired load or a desired displacement. Due to the effect of the torque M the hydromotor 8 and the rotor of the hydraulic transformer 3 commence rotation and oil begins to flow through the user's ports 4 and 5; usually the amounts of oil flowing through said two ports will be different as a result of the circuiting positions of the valves operated by the rotor being asymmetric in respect of the driving means, whereas the amount of oil flowing through the two ports of the hydromotor 8 is the same. Thus oil has to be supplied or discharged, and this is done via the 3/2-valve 7. The position of said valve 7 thus depends on the position of the adjustment device 19 and consequently on the pressure ratio at the ports 4 and 5.

In the situation where the pressures at the first user's port 4 and the second user's port 5 are the same, and the adjustment device 19 is in a position where no oil is supplied from the high-pressure connection 14 to the hydraulic transformer 3, the hydromotor 8 can commence rotation under the influence of the load, as a result of which the rotor in the hydraulic transformer 3 also commences rotation. With the aid of sensors coupled to the control 20, said rotation of the hydromotor 8 and the rotor can be detected and a braking torque M can be applied, causing the hydromotor 8 to come to a standstill yet. However, it may be desirable, and for safety reasons also compulsory, to let the motor come to a stand-still without the dynamic standstill adjustment described above having to take place, and to that end the stop valve 6 is provided. It suffices that the stop valve 6 stops the oil flow through one of the user's pipes.

The hydraulic system shown in FIG. 2 is similar to the system shown in FIG. 1 and works in a similar manner, with in FIG. 2 a linear hydromotor 11 being used which can be loaded with a load P in alternating directions, and in which two controlled non-return valves 12 are used for the alternate connection of the first user's port 4 and the second user's port 5 with the low-pressure pipe 9.

FIG. 3 shows a hydraulic system with a linear hydromotor 17 which is loaded with a load P in one direction, such as may be the case with, for instance, a winch or a jack. A connecting pipe 16 and a shuttle valve 15 connect the hydromotor 17 with the first user's port 4. The second user's port 5 is connected with the low-pressure pipe 9 and, via a short-circuiting pipe 18 provided with a restriction and a short-circuiting valve 13, with the first user's port 4. The high-pressure pipe 2 is connected with the high-pressure connection 14 via the shuttle valve 15.

In the middle position the shuttle valve 15 is executed such that the high-pressure pipe 2 is in communication with the high-pressure connection 14, whereas the connecting pipe 16 is then closed. When the hydromotor 17 stands still and the shuttle valve 15 is in the middle position, the short-circuiting valve 13 is open and the adjustment device 19 is adjusted such that the pressure at the first user's port 4 is slightly higher than at the second user's port 5, which causes oil to flow via the short-circuiting pipe 18 to the low-pressure pipe 9. The rotor of the hydraulic transformer 3 will now rotate at its lowest number of revolutions.

To start the rotor, extra activation of the adjustment device 19 may be necessary in order to displace the valves operated by the hydraulic transformer 3 with respect to the impellers of the chambers. This displaces the dead point, which may be determined by the limited number of chambers, and the rotor commences to rotate. After the rotor has reached a minimum number of revolutions its inertia will no longer bring it to a standstill in a dead point. By operating the adjustment device, the pressure at the first user's port 4 will also receive a boost, and after the rotor has been set in motion, this pressure may be reduced again.

In order to ensure that during operation the rotor does not come to a standstill and has to be restarted, the shuttle valve is used. If the directions of movement of the hydromotor 17 change, the rotor of the hydraulic transformer 3 can still keep rotating in the same direction. Therefore, when the load P on the hydromotor 17 diminishes, the connecting pipe 16 will be connected with the high-pressure connection 14 and the adjustment device will be adjusted such that the pressure is increased, causing the oil to flow via the first user's port 4 to the high-pressure pipe 2, and any energy released as a result of the displacement of the load is recovered in the form of hydraulic energy. While the load is in motion the short-circuiting valve 13 is closed. The short-circuiting valve 13 only opens at standstill of the hydromotor 17, and if the standstill is prolonged, the connecting valve 16 may be closed by the shuttle valve 15, allowing the pressure at the first user's port 4 to be adjusted to low pressure. This means that owing to said short circuiting flow the energy loss is minimal.

Apart from the embodiments described above numerous variations can be thought of in which the various techniques known to the person skilled in the art can be applied. The embodiments described above represent the different possibilities, and the embodiments, circuiting or operating techniques and the like as described for the one embodiment may very well be applicable for one of the other embodiments. Apart from the described applications using the double-sided rotating hydromotor, the invention may be applied unconditionally in situations with a double-sided linear hydromotor, and also with a rotating hydromotor of single-sided load.

What is claimed is:

1. A hydraulic system comprising a high-pressure pipe and a low-pressure pipe, a linear or rotating hydromotor which may be loaded with an alternate load, a hydraulic transformer coupled between the hydromotor, the high-pressure pipe and the low-pressure pipe comprising a housing with a rotor which is rotatable in the housing, a high-pressure connection connected with the high-pressure pipe, a first user's port and a second user's port, chambers distributed around the rotation shaft, driving means which, when the rotor rotates in the housing displace impellers, causing the volume of the chambers to vary between a minimum and a maximum value, channels provided with valves which are activated by the rotation of the rotor and which alternately connect the chambers with the high-pressure connection, the first user's port and the second user's port, and wherein an adjustment device can adjust the circuiting positions of the valves with respect to the rotational position of the driving means, characterized in that switching means are present for connecting the low-pressure pipe with the first user's port or with the second user's port.

2. A hydraulic system in accordance with claim 1, characterized in that the operation of the switching means is coupled with the operation of the adjustment device.

3. A hydraulic system in accordance with claim 1, characterized in that the switching means comprise valves which form part of the adjustment device.

4. A hydraulic system in accordance with claim 2, characterized in that the switching means comprise valves that are operated by means of a lever, which lever is coupled with the adjustment device.

5. A hydraulic system in accordance with claim 2, characterized in that the switching means comprise hydraulically operated valves which are activated by the pressure of the first user's port and the second user's port.

6. A hydraulic system in accordance with claim 2, characterized in that the switching means comprise electrically operated valves.

7. A hydraulic system comprising a high-pressure pipe and a low-pressure pipe, a linear or rotating hydromotor which may be loaded with an alternating load, a hydraulic transformer coupled with connecting pipes between the hydromotor, the high-pressure pipe and the low-pressure pipe comprising a housing with a rotor which is rotatable in the housing, a high-pressure connection connected with the high-pressure pipe, a first user's port and a second user's port, chambers distributed the rotation shaft, driving means which, when the rotor rotates in the housing displace impellers, causing the volume of the chambers to vary between a minimum and a maximum value, channels provided with valves which are activated by the rotation of the rotor and which alternately connect the chambers with the high-pressure connection, the first user's port and the second user's port, and wherein an adjustment device can adjust the circuiting positions of the valves with respect to the rotational position of the driving means, characterized in that a stop valve is provided in a connecting pipe between the hydraulic transformer and the hydromotor.

8. A hydraulic system in accordance with claim 7, provided with a control with which the adjustment device and the stop valve are coupled.

9. A hydraulic system in accordance with claim 7, in which the low-pressure pipe is optionally permanently connected with the first user's port or the second user's port, characterized in that a short-circuiting pipe is provided between the first user's port and the second user's port, optionally provided with a valve.

10. A hydraulic system in accordance with claim 9, having a hydromotor which is loaded in one direction, with a connecting pipe which is connected with the first user's port provided with a shuttle valve between the high-pressure pipe and the hydraulic transformer and the connecting pipe, and between the hydraulic transformer and the hydromotor.

11. A hydraulic system in accordance with claim 10, wherein the shuttle valve has a rest position for closing off the connecting pipe while the high-pressure pip is opened.

12. A hydraulic system in accordance with claim 1, in which the low-pressure pipe is optionally permanently connected with the first user's port or the second user's port, characterized in that a short-circuiting pipe is provided between the first user's port and the second user's port, optionally provided with a valve.

13. A hydraulic system in accordance with claim 12, having a hydromotor which is loaded in one direction, with a connecting pipe which is connected with the first user's port provided with a shuttle valve between the high-pressure pipe and the hydraulic transformer and the connecting pipe, and between the hydraulic transformer and the hydromotor.

14. A hydraulic system in accordance with claim 13, wherein the shuttle valve has a rest position for closing off the connecting pipe while the high-pressure pip is opened.

* * * * *

UNITED STATES PATENT AND TRADEMARK OFFICE

CERTIFICATE OF CORRECTION

PATENT NO. : 6,223,529 B1
DATED : May 1, 2001
INVENTOR(S) : Peter Augustinus Johannes Achten It is certified that error appears in the above-identified patent and that said Letters Patent is hereby corrected as shown below:

Column 6,
Line 36, delete "pip", insert -- pipe --

Signed and Sealed this

Twenty-sixth Day of February, 2002

*Attest:*

*Attesting Officer*

JAMES E. ROGAN
*Director of the United States Patent and Trademark Office*